United States Patent [19]

Ryan

[11] 4,023,517

[45] May 17, 1977

[54] RISER MOORING SYSTEM

[76] Inventor: William J. Ryan, P.O. Box 367, Loreauville, La. 70552

[22] Filed: Aug. 11, 1975

[21] Appl. No.: 603,345

[52] U.S. Cl. ..... 114/230; 9/8 P; 141/279; 141/388

[51] Int. Cl.[2] ..... B65B 3/04

[58] Field of Search ..... 114/230; 9/8 P; 141/279, 346, 382, 387, 388; 137/236

[56] References Cited

UNITED STATES PATENTS

| | | | |
|---|---|---|---|
| 2,727,534 | 12/1955 | Briede | 141/387 |
| 2,955,626 | 10/1960 | Hartley | 9/8 P |
| 3,360,810 | 1/1968 | Busking | 9/8 P |
| 3,572,408 | 3/1971 | Hnot | 114/230 |
| 3,620,268 | 11/1971 | Paddington | 141/279 |
| 3,750,723 | 8/1973 | Schirtzinger | 114/230 |
| 3,773,093 | 11/1973 | Eustace | 9/8 P |
| 3,820,488 | 6/1974 | Johnson | 137/236 |
| 3,844,240 | 10/1974 | Whitehouse | 9/8 P |

*Primary Examiner*—Trygve M. Blix
*Assistant Examiner*—Charles E. Frankfort
*Attorney, Agent, or Firm*—Pugh & Keaty

[57] ABSTRACT

An improved method of and structure for mooring for example supertankers offshore which combines the mooring process and the connections of cargo transfer lines into one simple operation and includes a mooring buoy capable of fluid transfer which is particularly adaptable to a super port type operation. The buoy includes a relatively long flotation caisson structure having a relatively small diameter, such proportion insuring greater stability in rough sea conditions. A flow line is located down the center of the buoyant caisson and extends above the bow of the ship it will service. A fitting is located on the top end of the flow line which is capable of securely attaching to a mooring pedestal located on the bow of the ship. This arrangement allows fluid flow between the riser structure and the ship as well as forming a substantial mooring linkage between the ship and the anchor lines which are attached to the bottom of the buoy. The system also includes the use of a mooring winch on the ship. The line from the winch is conducted through the hawse pipe in the center of the mooring pedestal and is attached to a hang line, which extends down from the center of the attaching head of the riser structure. The winch will pull the attaching head down around the mooring pedestal where it is automatically latched. This simple operation moors the ship as well as connects the fluid lines.

15 Claims, 9 Drawing Figures

RISER MOORING SYSTEM

REFERENCE TO RELATED APPLICATION

This application in its method and structure of mooring and releasing contains subject matter similar to the method and structure of mooring and releasing in copending application Ser No. 501,991, filed Aug. 30, 1974, entitled "Combined Marine Ramp and Transfer System."

BACKGROUND OF THE INVENTION

1. Field of the Invention

The present invention relates to a combined marine mooring and cargo transfer system for use for example between a supertanker offshore and a pipeline to shore based facilities.

The invention relates to a relatively stable floating pipeline which rises from the ocean floor to a position well above the hull of the ship. It is held in a relatively vertical position by the buoyant force of the water and has articulating ability to weathervane. It will conform to all of the movements of the ship while limiting its horizontal movements.

The present invention also relates to the method of attaching the top of the floating riser to the mooring pedestal on the bow of the ship by means of a mooring winch which overcomes the buoyant force of the riser. The attachment allows fluid to flow between the ship and the riser while performing the mooring function.

The invention also relates to the elements of articulation such as: flow through pins in universal joints, and heavy duty swivel joints which have the structural ability to accommodate the mooring forces as well as conduct fluid flow.

The method of cushioning the tension and compression of the mooring loads on the riser is included in the invention.

The method of using an anchor mat which is capable of attaching itself to the bottom as well as removing itself back to a floating condition is also included.

The purpose of the present invention is to increase the ability to operate in rough sea conditions, increase safety for the workers, decrease the possibility of spillage, decrease maintenance, reduce the time necessary for mooring and cargo line connections, decrease the time of departure, simplify required operating facilities, reduce manpower requirements, reduce operational cost, and in general to relieve or eliminate many other problems in the conventional systems.

2. Description of the Prior Art

One of the major problems facing the superport operations today is that of attaching the mooring lines in rough sea conditions. The most popular techniques involve the attachment of mooring lines to a relatively active anchor buoy. This is accomplished by a boat which picks up the mooring lines. A man from the boat boards the buoy and makes the attachment. Or he must attach the mooring lines from the ship to floating mooring lines from the buoy. Seas that have wave heights of 5 feet or better make this attachment method dangerous or it might not be attempted at all. Delays because of weather limit productivity and is very expensive. Also, the most popular systems involve floating hoses which connect the flow lines on the ocean bottom to the cargo piping on the ship. These hoses are also handled by boats that position them next to the ship, where they are lifted aboard by cranes on the ship. Obviously, this operation becomes hazardous in rough sea conditions. These hoses then must be hand connected to the ship's piping system. This operation requires many men, boats and time.

Floating hoses are very expensive and must be changed frequenty because of the high stress exerted on them by the action of the waves. Another problem of floating hoses is that they can become pinched between the ship and the buoy, should the ship drift into the buoy. Such pinching activity normally requires the changing of the hoses or may even cause spillage.

The single point mooring (SPM) system is considered by many to be the safest and most economical method of offshore superport operations. It is not new in the art since it has been in operation since 1959.

The elements of the SPM system is a floating buoy which is anchored to the ocean floor and serves as a mooring buoy. A flow line from shore facilities is located on the sea bottom being connected to a flexible hose in the area of the buoy anchor. It extends to the surface where it attaches to floating hoses which are connected to the ship's cargo lines. This arrangement allows the ship to weathervane around the anchor while the cargo is being transferred.

Typical examples of the prior art in the offshore tanker cargo transfer are the following U.S. Patents:

| Patent No. | Date Issued | Inventor |
|---|---|---|
| 3,017,934 | Jan. 23, 1962 | A. D. Rhodes, et al. |
| 2,955,626 | Oct. 11, 1960 | A. C. Hartley |
| 3,360,810 | Jan. 2, 1968 | B. E. Busking |
| 3,372,049 | Mar. 12, 1968 | W. T. Manning |
| 3,409,055 | Nov. 5, 1968 | P. J. Bily |
| 3,407,416 | Oct. 29, 1968 | A. A. Brickhouse |
| 3,434,442 | Mar. 25, 1969 | W. T. Manning |

However, none of these patents disclose a relatively solid but flexible riser which is capable of structurally mooring the vessel while performing the function of cargo transfer in one manipulation.

SUMMARY DISCUSSION OF THE INVENTION

In contrast to prior art actually used in offshore superport operations, the present invention utilizes a unique riser design which is basically rigid but is equipped with articulating elements which enables it to move in all directions to conform to the movements of the ship. The riser structure is designed to accommodate the mooring forces produced by the ship as well as form a method of internally conducting cargo between the ship and other facilities.

The basic, over-all object of the present invention is to provide a simplified method of mooring supertankers offshore, which combines the mooring process and the connection of cargo transfer piping into one simple operation and structure.

Another object of the present invention is to provide a relatively stable mooring and cargo transfer buoy that a ship can attach to, and release from, in rough sea condition.

Another object of the present invention is to increase safety by minimizing the necessity of personnel to handle equipment. The man that does handle equipment does so in a more stable environment. No one is required to be in an area where heavy equipment is being moved.

Another object of the present invention is to minimize the possibility of cargo spillage by reducing the amount of moving parts. The elements that are required for complete articulation are located in areas that are not subjected to the ship running into them. These parts are also designed for severe use and long life. Flexible hoses, if used at all, are subjected to minimal movements. They are not located where they are subjected to severe wave action or where the ship can hit them.

Another object of the invention is to reduce maintenance by simple, heavy duty design. Should the ship run across the buoy, it will push it over and pass by. Very expensive, short life, floating hoses are eliminated.

Another object of the present invention is to minimize the time required to moor the ship and to attach the cargo transfer lines. This simple technique of attaching the riser to the ship can be accomplished in a matter of minutes even in rough seas. Whereas, the conventional method may take several hours or may even require waiting for the sea to subside, in order to moor at all.

The present invention can release from its cargo piping and mooring in a matter of seconds, where the conventional method may take hours.

Another object of the present invention is to minimize the necessary facilities and manpower requirements. Only one winch and operator is required to moor the ship and connect the cargo transfer piping; whereas, the conventional methods require boats and crews to handle the mooring lines and floating hoses, and also a service derrick is required on the ship to lift the hoses aboard, and men are also required to be on deck to handle the hoses and make the connections.

Another object of the present invention is to reduce operational cost by reducing maintenance, manpower requirements, eliminating floating hoses, and minimal tug requirements.

A summary of the advantages of the present invention is as follows:

1. Simple construction.
2. Minimum maintenance.
3. High stability.
4. Minimum space required while not in operation.
5. High ecology value (spillage minimized).
6. Low fouling characteristics.
7. Base of attachment.
8. Mooring can be safely and easily accomplished in rough sea conditions.
9. No expensive floating hoses are required.
10. No boats are required to handle hoses.
11. Only one man is needed to handle the mooring rigging.
12. Operational safety is increased.
13. The time required to moor the ship and begin cargo transfer is a matter of minutes.
14. Ship standby time is minimized.
15. Disconnection of the cargo lines and release from the mooring buoy is accomplished by one man in seconds.
16. The cost of the present invention should be less than other systems now in use.

BRIEF DESCRIPTION OF THE DRAWINGS

For a further understanding of the nature and objects of the present invention, reference should be had to the following detailed description, taken in conjunction with the accompanying drawings, wherein like elements are given like reference numberals and wherein:

FIG. 1 is a side view of the preferred embodiment of the riser mooring system of the present invention, showing it in its floating, non-use disposition; while FIG. 2 is a similar, side view of the preferred embodiment of FIG. 1, while in its moorlng disposition.

FIGS. 6 and 7 are plan and side, partial views, respectively, showing the oil flow into connection in the head of the riser mooring system of the present invention; while

DESCRIPTION OF PREFERRED EMBODIMENTS

Figures 1, 2:
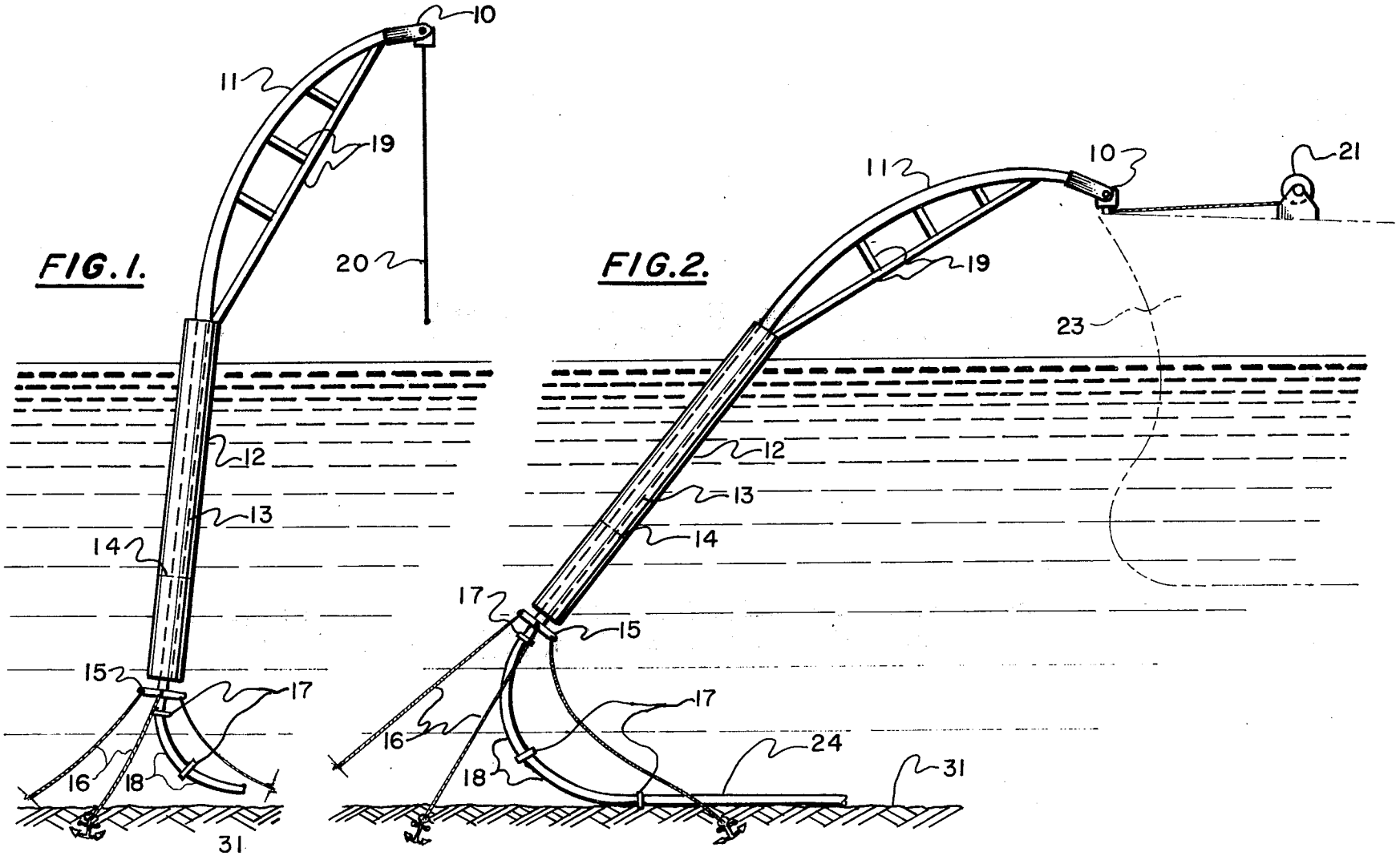

FIG. 1 is a generalized profile view of the preferred embodiment of the riser of the present invention in a free-floating state. "Hang line" 20 is a Nylon line fixed in the center of the riser head 10. It is used to attach the riser head 10 to the pedestal 40 on the bow of the ship 23, as will be explained more fully below.

The riser stem 11 is stiffened by means of a truss 19.

The bottom of the flow line 13 is attached to a flexible hose 18 by means of a swivel connection 17. Additional swivels 17 are added to the hose 18 to prevent torque.

Anchor lines 16 are attached to swivel arms 15 which prevent fouling.

The general configuration of the riser system lends to considerable stability in rough sea conditions. This is the result of the relatively long length of the flotation caisson 12 which has a minimum diameter.

A ballast bulkhead 14 is provided which will allow flooding in order to lower the center of gravity and increase stability.

The long flotation caisson 12 will position the anchor lines below the bottom of the ship to prevent fouling.

FIG. 2 is also a general profile, similar to FIG. 1, but showing the riser attached to the pedestal 40 on the bow of the ship 23. This connection moors the ship and allows the cargo to flow between the ship 23 and the riser 10.

This arrangement allows the ship to weathervane about its anchor lines 16 and will work very well in deep water where the ship cannot damage the flexible hose 18 by pushing it into the ocean floor 31.

Figures 3, 4:
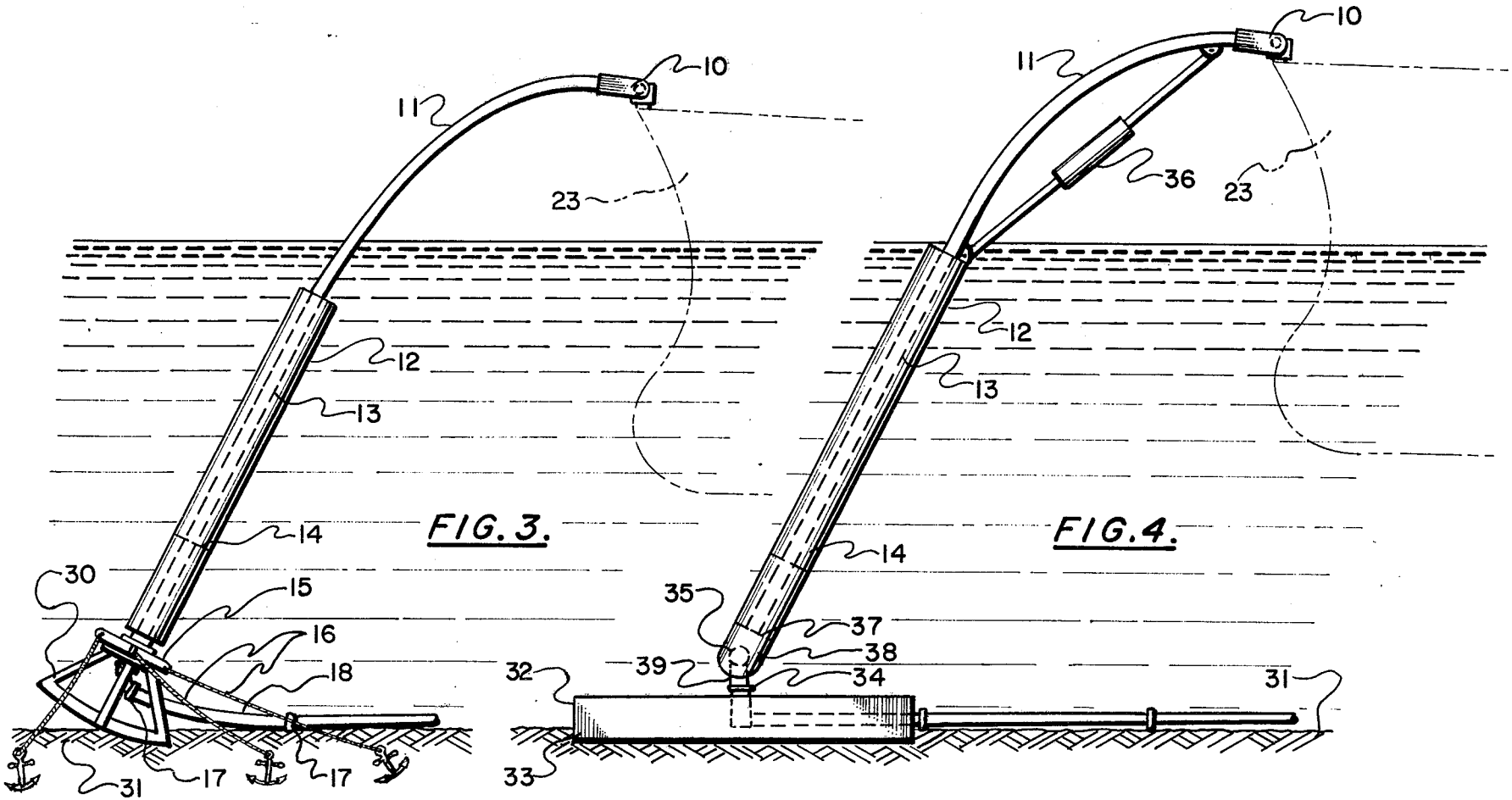
FIGS. 3 and 4 are side views of two additional embodiments of the riser mooring system of the present invention, showing them while in their mooring disposition.

FIG. 3 is a profile of a second embodiment of the riser system attached to the ship 23, showing the action of of the riser system as the ship drifts into it. The inboard anchor lines 16 are in tension while the motion of the ship 23 will force the riser downward. A swivel bottom shoe 30 is provided in this embodiment to protect the flexible hose 18 from damage from the ocean floor 31.

In the embodiment of FIG. 3, an upper truss (element 19 of FIGS. 1 & 2) is not used and the riser stem 11 is constructed of a tubular member which has a built-in curve. Material used in the riser stem 11 has spring qualities which allow bending from tension or compression but will return to its original shape. This will cushion the mooring loads.

FIG. 4 is a profile of a third embodiment of the riser system showing the ship 23 attached to the riser system. In this embodiment, the riser is fixed to the ocean floor 31 by means of a bottom mat 32 which is equipped with shear fins 33 that penetrate the ocean floor 31 to resist movement. Anchors (not shown) or other means may also be added to resist the movement of the bottom mat.

The riser is connected to the bottom mat 32 by means of a heavy duty swivel 34 and flow-through hinge pin 35. This arrangement will allow complete articulation of the riser and eliminate the flexible hose with its high maintenance cost. Fluid is transferred through this connection.

The sump bulkhead 37 is welded tight to the flow line 13 and the inside of the flotation caisson 12 forming a chamber for fluid to flow through the hoke jaws 38 and through the flow-through hinge pins 35 into the swivel connector 39.

The embodiment of FIG. 4 also includes a shock absorber 36 attached to the riser stem 11 in order to assist in the cushioning of the mooring loads. If the riser stem 11 is equipped with a flow-through hinge, then there will be no bending in the riser stem and the shock absorber 36 must assume all of the mooring forces as well as the cushioning activity.

Figure 5:
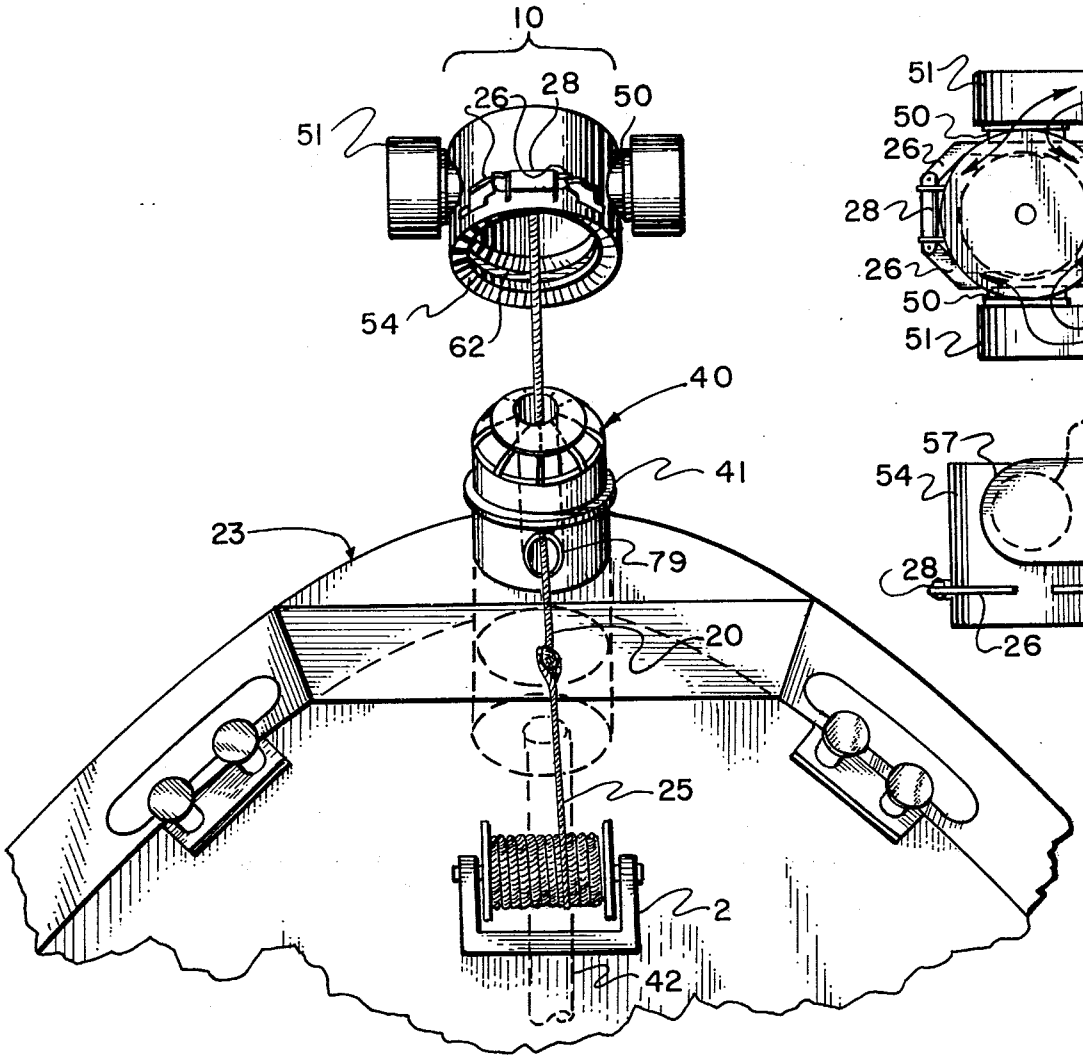
FIG. 5 is a top, perspective view of the attachment structure used between the head of the riser mooring system and the bow of the ship to be moored, showing their disposition immediately prior to attachment.

FIG. 5 is a top perspective view of the bow of the ship equipped with a combined mooring and cargo transfer pedestal 40. The riser head 10 is shown being pulled down by the mooring winch 21 where it will be positioned around the pedestal 40. The latching members 26 will engage themselves under the vertical retainer ring 41 to maintain the coupling (see also FIG. 9).

Cylinders 26, or other suitable means are provided to push the latching members outboard to release the connection. This action will allow the bouyant force of the riser to lift the riser head 10 off of the pedestal 40. The hang line 20, which has been disconnected from the winch line 25, will follow through the pedestal hawser pipe 79 making the ship 23 completely free of the riser system.

The pedestal 40 is securely fastened into the bow of the ship in a structurally desirable manner to withstand the mooring forces. A cargo transfer line 42 is welded into the pedestal to permit fluid flow through this connection. As a result, all supplemental or separate anchor lines or mooring chains are eliminated, and the mooring and fluid transfer functions are combined into a unitary, simplified structure.

Figure 6:
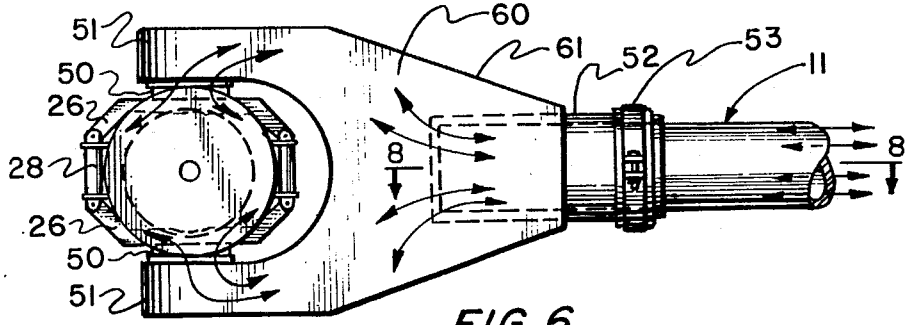

FIG. 6 is a plan view of the riser head assembly 10. Flow arrows indicate the path of the fluid between the pedestal 40 and the riser stem 11 by means of the hollow pin 50, and the hollow yoke jaws 51. A swivel collar 52 is provided around the riser stem 11 to allow rotational movement in order to compensate for the transverse movements of the ship.

The latching members 26 are also shown in an inboard position. Cylinders 28 are spring loaded to maintain the latching members 26 in the inboard position. However, the springs do allow outboard movement of the latching members 26 in order to engage under the retainer ring 41 to prevent the riser head 10 from lifting off of the ship's pedestal 40.

Pressure applied to the cylinders 28 will push the latching members 26 outboard of the retainer ring 41 during the releasing procedure.

Oil seal 53 is provided to prevent leakage between the riser stem 11 and the swivel collar 52.

Figure 7:
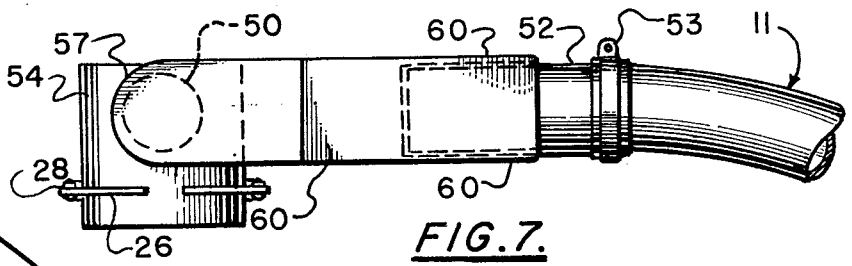

FIG. 7 is a side view of the riser head assembly 10. The pedestal housing 54 can rotate around the flow-through pins 50 to compensate for the vertical and horizontal movements when it is attached to the ship's pedestal 40.

Figure 8:
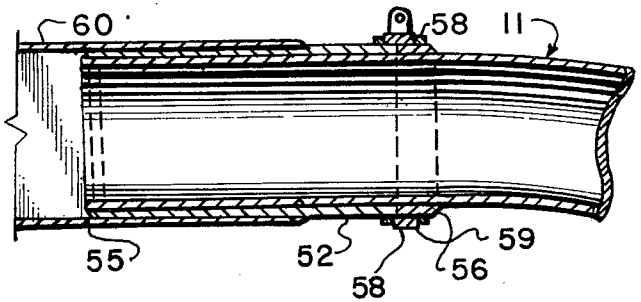
FIG. 8 is a cross-sectional, side view of the piping into connection, taken along section lines 8—8 of FIG. 7.

FIG. 8 is a vertical, cross-sectional view at the centerline along section lines 8—8 of FIG. 7, illustrating structural arrangement between the riser stem 11 and the swivel collar 52. The rings 55 and 56 are welded to the riser stem 11 on both ends of the swivel collar 52 to prevent longitudinal movement. Since these rings are independent of the swivel collar 52, the riser head assembly 10 is free to rotate about the riser stem 11.

The stop ring 56 and the swivel collar 52 have machined surfaces of identical diameters in way of the seal 58 between the seal stops 57. These stops 57 will maintain the position of the adjustable seal tightener 59 and the seal 58.

The top and bottom plates 60 and the side plates 61 are welded to the swivel collar 52 in an oil-tight manner.

Figure 9:
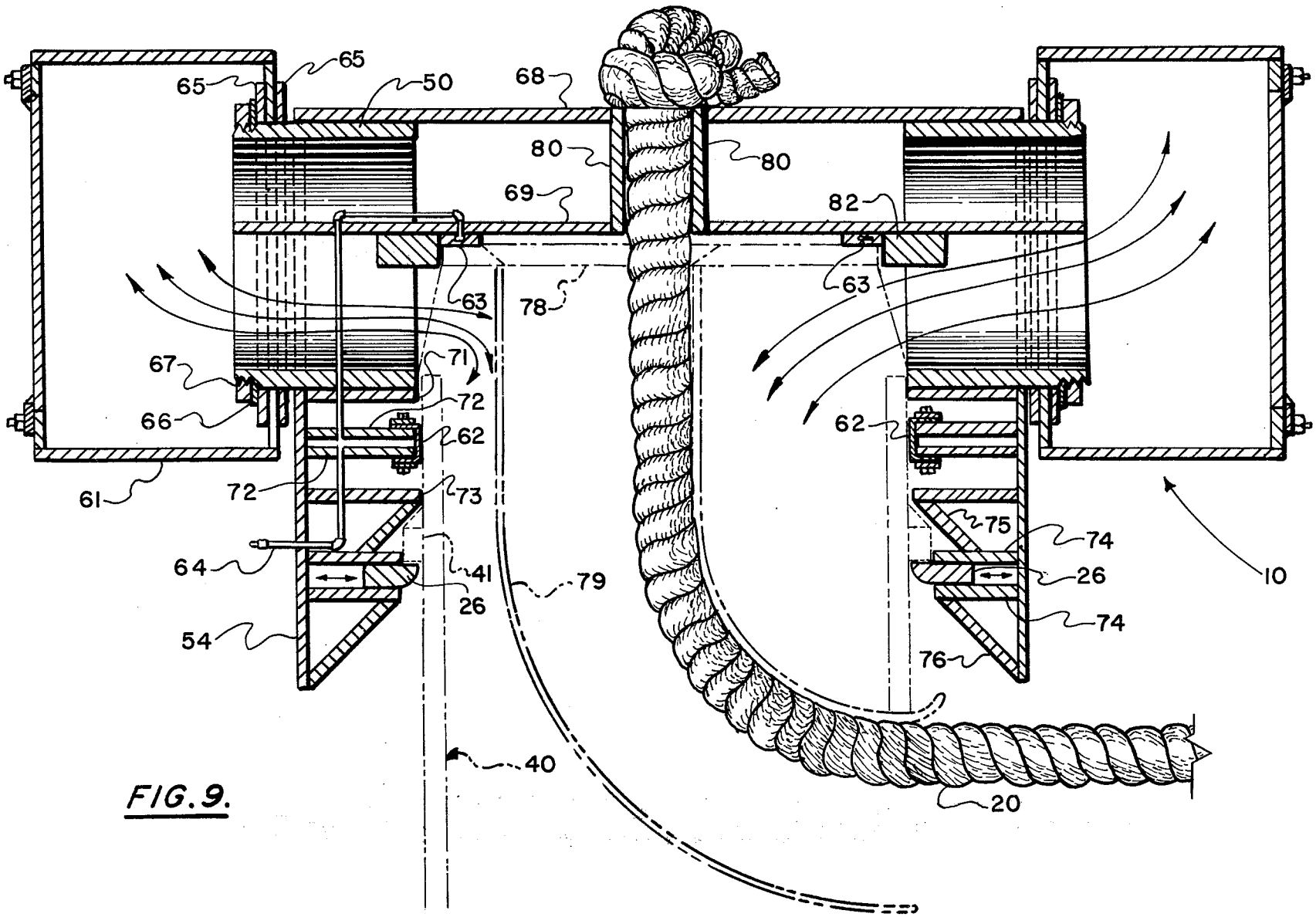
FIG. 9 is a side, cross-sectional view of the mooring pedestal on the ship's bow with the riser head connected thereto, showing the oil flow into connection therebetween.

FIG. 9 is a side, cross-sectional view at the centerline of the connection between the riser head assembly 10 and the ship's pedestal 40, with the pedestal structure being illustrated in phantom line and the arrows indicating fluid flow.

An expandable side seal 62 is provided to allow maximum clearance between the structures while assuring an oil-tight seal.

Another expandable seal 63 is provided to prevent leakage between the top of the pedestal 78 and the hinge stiffener plate 69.

A pressure line 64 is located in an appropriate position to expand the seals and provide an oil-tight condition.

The flow-through pins 50 are welded to the pedestal housing 54 in an oil-tight manner.

The inboard jaw plate 70 is designed to accommodate all of the forces in the system. Doubler rings 65 in conjunction with jaw plate 70 are designed to supply adequate bearing surfaces for the flow-through pins 50.

Seal 66 is supplied to make an oil-tight connection between the flow-through pins 50 and the riser head assembly 10. A screw type pressure ring 67 will keep the seal 66 oil tight. It is not intended that the seal arrangement be limited to this configuration as it may be adequately handled in many other ways.

The top plate 68 is welded oil-tight to the flow-through pins 50 and the pedestal housing 54.

A hang line sleeve 80 is welded oil-tight in the center of top plate 68 and the hinge stiffener plate 69.

Ring 82 is designed to transmit the mooring forces between the top of the ship's pedestal 40 and the riser head assembly 10. It is welded oil-tight to the hinge stiffener plate 69 which maintains structural continuity to the flow-through pins 50.

The hinge stiffener plate 69 also forms an oil-tight barrier between the top plate 78 of the pedestal 40 and the riser head assembly 10 by means of the expandable seal 63.

Horizontal rings 71, 72, 73 and 74 associated with vertical stiffeners (not shown) are designed to transmit the mooring forces between the sides of the ship's pedestal 40 and the riser head assembly 10. Rings 72 are welded tight to the cylindrical housing 54 and forms a pressure chamber for the expandable seal 62. Rings 74 form a housing for the latching members 26. They are designed to clear the vertical retainer ring 41 which is welded to the ship's pedestal 40.

Latching members 26 are designed with a beveled bottom in order that they will be forced outboard as they are pulled down over the retainer rings 41. Springs will return these latching members 26 under the rings 41 (as shown). This will prevent the riser head assembly 10 from inadvertently lifting off of the ship's pedestal 40.

Sloping rings 75 and 76 are provided to add strength as well as to assist in the stabbing operation when the hang line 20 is pulling the riser head 10 over the ship's pedestal 40.

Since there is considerable shear and chaffing action on the top area of the hang line 20, as the riser head assembly 10 is being pulled down around the ship's pedestal 40, a short section of chain, wire rope, or other flexible, mechanical resistant material may be used more effectively. However, it is important that most of the length of the hang line 20 be of a stretchable material such as Nylon line.

The ship's pedestal 40 (shown in phantom line) is a tubular member of suitable strength to support the mooring forces. It is also connected to the ship's cargo transfer piping in order that the fluid may be pumped through it.

An ell shaped hawser pipe 79 is welded oil-tight into the ship's pedestal 40 as shown. The ends of the hawser pipe 79 are bell shaped to reduce chaffing of the winch line 25 and the hang line 20.

For a further understanding of the method and structure of mooring and releasing the riser head 10 to the ship pedestal 40, reference is had to prior, copending application Ser. No. 501,991, filed Aug. 30, 1974, entitled "Combined Marine Ramp and Transfer System" wherein the boat attached 14 and docking pedestal 15 are generally analogous.

Although the embodiments described in detail supra have been found to be most satisfactory and preferred, many variations in their structure or use are, of course, possible.

Because many varying and different embodiments may be made within the scope of the inventive concept herein taught, and because many modifications may be made in the embodiments herein detailed in accordance with the descriptive requirements of law, it is to be understood that the details herein are to be interpreted as illustrative and not in a limiting sense.

What is claimed as invention is:

1. A marine riser mooring system, wherein fluids are to be transferred between a source on the water bottom and a marine vessel, capable of use in both calm and rough weather conditions, comprising the following elements:

a. an elongated, buoyant riser means for transmitting fluids between the source and the vessel, said riser means being connected at its lower end portion to the source and connectable at its upper end portion to the vessel;

b. anchor means attached to said lower end portion of said riser means for anchoring it to the water bottom;

c. articulation means, joining the source and the lower end portion of said riser means, for allowing articulation of said riser means in all directions with respect to the source and the water bottom;

d. a structural pedestal rigidly fixed to said vessel, said pedestal provided with a fluid conveying aperture therein; and e. a riser head rotatably and pivotally connectable to said pedestal by connection means for allowing articulation in all directions, said riser head comprising:

a fluid transmitting bifurcated yoke, said yoke being sealably fitted to said riser means, and a fluid transmitting pedestal cap, said cap being pivotally, sealably connected to said yoke at the bifurcations of said yoke, such that fluid can be transmitted through the bifurcations in said yoke through said pedestal cap, said cap being sealably connectable to said pedestal to allow fluid transmission between said pedestal cap and the aperture of said pedestal.

2. The system of claim 1 wherein said head connection means allows the vessel to pivot about said riser means about both a pivot axis perpendicular to and a hinge axis parallel to the major "horizontal" plane of the water level.

3. The system of claim 2 wherein said transfer system also provides mooring capability, said system being a combined fluid transfer and mooring system, and wherein said head connection means is fixed with respect to the vessel when in use, said two axes being fixedly located with respect to the vessel and said riser means having a constant length.

4. The system of claim 3 wherein the forces created by the relative movement of the vessel and the water bottom are transmitted between them only through said head connection means.

5. The apparatus of claim 1, further comprising winch means for bringing said riser head into cooperation with said pedestal so that said riser head and said pedestal can be structurally connected.

6. The apparatus as recited in claim 5, in which the winch means comprises:

a. a hang line suspended from said riser head;

b. hawser pipe means for threadably guiding said hang line through said pedestal; and c. winch means attachable to said hang line for pulling said hang line through said hawser pipe means so that said riser head will dock on said pedestal.

7. The apparatus as recited in claim 6, further comprising latch means for securing said riser head on said pedestal.

8. The apparatus as recited in claim 7, in which the latch means comprises:

a. a circular outwardly extending flange rigidly affixed to said pedestal;

b. reciprocating catch means on said riser head for clamping said circular flange when said riser head couples with said pedestal, said catch means provided with resilient means which allows said catch means to expand when said riser head is fitted over said flange and contracts when said riser head is completely coupled with said pedestal, such that said catch means engages the underside of said flange thereby preventing the removal of said riser head from said pedestal.

9. The apparatus as recited in claim 8 wherein said riser head is provided with seal means for preventing leakage of fluid from said system when said fluid is transferred from said riser means to said head and said pedestal.

10. The apparatus as recited in claim 9 wherein said seal means is a pressure activated seal.

11. The apparatus as recited in claim 1, wherein said riser means is provided with truss means for stiffening said riser means.

12. The apparatus as recited in claim 1, wherein said riser means is provided with a shock absorber means for stiffening said riser means, said shock absorber means being attachable to the upper and central portions of said riser means at respective end portions of said shock absorber means.

13. A marine riser mooring system, wherein fluids are to be transferred between a source on the water bottom and a marine vessel, capable of use in both calm and rough weather conditions, comprising the following elements:

a. an elongated, buoyant riser means for transmitting fluids between the source and the vessel, said riser means being connected at its lower end portion to the source and connectable at its upper end portion to the vessel;

b. anchor means attached to said lower end portion of said riser means for anchoring it to the water bottom;

c. articulation means, joining the source and the lower end portion of riser means, for allowing articulation of said riser means in all directions with respect to the source and the water bottom;

d. a structural pedestal rigidly fixed to said vessel, said pedestal provided with a fluid conveying aperture therein; and e. a substantially rigid riser head having connecting means rotatably and pivotally connectable to said pedestal for allowing articulation in all directions, said riser head being sealably fitted to said riser means, said riser head having a fluid transmitting portion, said fluid transmitting portion of said riser head being in cooperation with said riser means and said pedestal such that fluid flow is possible from said riser means through said riser head into said fluid conveying aperture of said pedestal.

14. The method of temporarily attaching a marine transfer and mooring riser system between the water bottom on which a riser structure is anchored and a marine vessel, wherein the vessel can rotate about a vertical "axis" about the end of a riser, comprising the following steps:

a. Providing a marine transfer and riser mooring system, which system comprises:

an elongated buoyant riser means for transmitting fluids between the source and the vessel, said riser means being connected at its lower end portion to the source and connectable at its upper end portion to the vessel;

anchor means attached to said lower end portion of said riser means for anchoring it to the water bottom;

articulation means, joining the source and the lower end portion of said riser means, for allowing articulation of said riser means in all directions with respect to the source and the water bottom;

a structural pedestal rigidly fixed to said vessel, said pedestal provided with a fluid conveying aperture therein and a pull line guiding hawse pipe; and a riser head having connecting means rotatably and pivotally connectable to said pedestal for allowing articulation in all directions, said riser head having a fluid transmitting portion, said fluid transmitting portion being in operable and structural connection with said riser means and the aperture of said pedestal, such that fluid flow is possible from said riser means through said riser head and into said aperture of said pedestal;

a hang line suspendedly attached at one end portion to said riser head;

and winch means attached to the vessel for pulling said hang line of said riser head through said hawse pipe of said pedestal, said winch means having a pull line wrapped thereon;

b. Pulling said pull line with said hang line connected thereto through said hawse pipe of said pedestal utilizing said winch means, thereby pulling said pedestal and said riser head together; and c. connecting said pedestal and said riser head together.

15. The method of temporarily attaching a marine transfer and mooring riser system between the water bottom on which a riser structure is anchored and a marine vessel, wherein the vessel can rotate about a "vertical" axis about the end of a riser, comprising the following steps:

a. providing a marine transfer and riser mooring system, which system comprises:

a buoyant riser means for transmitting fluids between a source and a vessel, said riser means being connected at its lower end portion to the source and connectable at its upper end portion to the vessel;

anchor means attached to the lower end portion of said riser means for anchoring the lower end portion of said riser means to the water bottom;

articulation means joining the source and the lower end portion of said riser means, for allowing articulation of said riser means in all directions with respect to the source and the water bottom;

a structural pedestal rigidly fixed to said vessel, said pedestal provided with a fluid conveying aperture therein and a pull line guiding hawse pipe;

a riser head rotatably and pivotally connectable to said pedestal allowing articulation in all directions, said riser head comprising a fluid transmitting bifurcated yoke, said yoke being sealably fitted to said riser means, a fluid transmitting pedestal cap, said cap being pivotally, sealably connected to said yoke at the bifurcations of said yoke, such that fluid can be transmitted through the bifurcations in said yoke through said pedestal cap, said cap being sealably connectable to said pedestal to allow fluid transmission between said pedestal cap and the aperture of said pedestal, and a hang line suspendedly attached at one end portion to said cap; and winch means attached to the vessel for pulling said hang line of said cap through said hawse pipe of said pedestal, said winch means having a pull line wrapped thereon;

b. pulling said pull line with said hang line connected thereto through said hawse pipe of said pedestal utilizing said winch means, thereby pulling said pedestal and said riser head together; and c. connecting said pedestal and said riser head together.

* * * * *